US008491075B2

(12) United States Patent
Zhou et al.

(10) Patent No.: US 8,491,075 B2
(45) Date of Patent: Jul. 23, 2013

(54) METHOD AND APPARATUS FOR CONTROLLING JETTING PERFORMANCE IN AN INKJET PRINTER

(75) Inventors: Jing Zhou, Webster, NY (US); Paul Windsor Morehouse, Jr., Webster, NY (US); Joseph Martin Antonio, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 337 days.

(21) Appl. No.: 13/023,719

(22) Filed: Feb. 9, 2011

(65) Prior Publication Data

US 2012/0200624 A1 Aug. 9, 2012

(51) Int. Cl.
*B41J 29/38* (2006.01)

(52) U.S. Cl.
USPC ..... 347/10; 347/14

(58) Field of Classification Search
CPC ..... B41J 2/14233; B41J 2/17556; B41J 2/2128
USPC ..... 347/9–12, 14
See application file for complete search history.

(56) References Cited

U.S. PATENT DOCUMENTS

| | | | | |
|---|---|---|---|---|
| 4,509,062 | A | 4/1985 | Low et al. | |
| 4,929,969 | A | 5/1990 | Morris | |
| 5,847,734 | A | 12/1998 | Pawlowski, Jr. | |
| 5,880,748 | A | 3/1999 | Childers et al. | |
| 5,929,875 | A | 7/1999 | Su et al. | |
| 5,992,990 | A | 11/1999 | Childers et al. | |
| 6,029,896 | A | 2/2000 | Self et al. | |
| 6,137,513 | A | 10/2000 | Pawlowski, Jr. et al. | |
| 6,164,742 | A | 12/2000 | Hauck | |
| 6,183,078 | B1 | 2/2001 | Pietrzyk et al. | |
| 6,250,747 | B1 | 6/2001 | Hauck | |
| 6,394,593 | B1 | 5/2002 | Komplin et al. | |
| 6,402,283 | B2 | 6/2002 | Schulte | |
| 6,464,346 | B2 | 10/2002 | Otis, Jr. et al. | |
| 6,890,051 | B2 | 5/2005 | Otis, Jr. | |
| 7,029,084 | B2 * | 4/2006 | Schloeman et al. | 347/9 |
| 7,275,807 | B2 | 10/2007 | Van Tuyl | |
| 7,396,109 | B2 | 7/2008 | Courian | |
| 7,500,737 | B2 | 3/2009 | Lewey et al. | |
| 7,651,204 | B2 | 1/2010 | Nathan et al. | |
| 7,762,651 | B2 | 7/2010 | Stathem et al. | |
| 8,042,898 | B2 * | 10/2011 | Shibata | 347/9 |
| 8,172,352 | B2 * | 5/2012 | Okada et al. | 347/11 |
| 2008/0204501 | A1 | 8/2008 | Kurita et al. | |
| 2009/0147060 | A1 | 6/2009 | Ito et al. | |
| 2010/0053283 | A1 | 3/2010 | Ito | |
| 2010/0231669 | A1 | 9/2010 | Ito | |

* cited by examiner

*Primary Examiner* — An Do
(74) *Attorney, Agent, or Firm* — Maginot, Moore & Beck, LLP

(57) ABSTRACT

A printer receives print jobs and identifies at least one parameter associated with a print job to select a pressure level for at least one ink reservoir and at least one firing signal waveform for operating a printhead in the printer. The selected pressure and waveform enable optimal image quality for existing conditions identified from the print jobs performed by the printer.

20 Claims, 3 Drawing Sheets

METHOD AND APPARATUS FOR CONTROLLING JETTING PERFORMANCE IN AN INKJET PRINTER

TECHNICAL FIELD

The process and device described below relate to imaging devices and, more particularly, to inkjet printheads in inkjet imaging devices.

BACKGROUND

Inkjet printers form a printed image by ejecting or "jetting" drops of liquid ink onto an image receiving surface, such as an intermediate transfer surface or a media substrate. Inkjet printers typically include a printhead and a printhead controller. The printhead controller, among other functions, generates and sends firing signals to the printhead. The firing signals are delivered to inkjet ejectors in the printhead to cause the inkjets to eject drops of liquid ink upon an image receiving surface to form at least a portion of a printed image.

In general, the printhead of an inkjet printer includes a plurality of ink ejectors and at least one reservoir for containing a supply of ink. Specifically, a monochromatic inkjet printhead may include a single reservoir in which a single color of ink is stored. A full color inkjet printhead may include a plurality of reservoirs, with each reservoir configured to contain a different color of ink. The ink ejectors eject very small drops of the ink onto an image receiving surface in response to receiving a firing signal from the printhead controller. Often, a group of one hundred to six hundred individual ink ejectors in a printhead are coupled to an ink reservoir. In particular, a monochromatic printhead may include a single group of ink ejectors fluidly coupled to the single reservoir, while a full color printhead may include a separate group of ink ejectors for each of the reservoirs. Thus, a full color printhead having four reservoirs may have four distinct groups of ink ejectors, each being coupled to a different ink reservoir. The ink drops ejected from the printhead may have various masses and the inkjet ejectors may eject the drops with different velocities. The mass and velocity of ink drops may affect image quality, and a single printer may have multiple print modes that operate the printheads to eject ink drops with different masses and velocities. Consequently, further developments in the operation of inkjet printheads are desirable.

SUMMARY

In one embodiment, a method for operating a printer has been developed. The method includes identifying at least one parameter associated with a print job, selecting a firing signal waveform corresponding to the identified parameter, selecting a pressure corresponding to the identified parameter, operating at least one ink ejection device with reference to the selected firing signal waveform and the selected pressure.

In another embodiment, a printer has been developed. The printer includes an ink reservoir configured to contain a supply of ink and an air space above the supply of ink, an air pressure device fluidly coupled to the air space above the supply of ink, at least one ink ejection device fluidly coupled to the ink reservoir, and a controller coupled to the at least one ink ejection device and the air pressure device. The at least one ink ejection device is configured to receive ink from the supply of ink and to eject ink onto an image receiving surface. The controller is configured to identify a parameter associated with a print job, select a firing signal waveform corresponding to the identified parameter, select a pressure corresponding to the identified parameter, provide the selected firing signal waveform to the at least one ink ejection device, and activate the air pressure device to establish the selected pressure in the air space above the supply of ink.

In another embodiment, a printer that forms images using gel ink has been developed. The printer includes an ink reservoir configured to contain a supply of a gel ink and an air space above the supply of gel ink, an air pressure device fluidly coupled to the air space above the supply of gel ink, at least one ink ejection device fluidly coupled to the ink reservoir, and a controller coupled to the at least one ink ejection device and the air pressure device. The at least one ink ejection device is configured to receive liquefied gel ink from the supply of gel ink and to eject the liquefied gel ink onto an image receiving surface. The controller is configured to identify a parameter associated with a print job, select a firing signal waveform corresponding to the identified parameter, select a pressure corresponding to the identified parameter, provide the selected firing signal waveform to the at least one ink ejection device, and activate the air pressure device to establish the selected pressure in the air space above the supply of gel ink.

DETAILED DESCRIPTION

Figure 1:
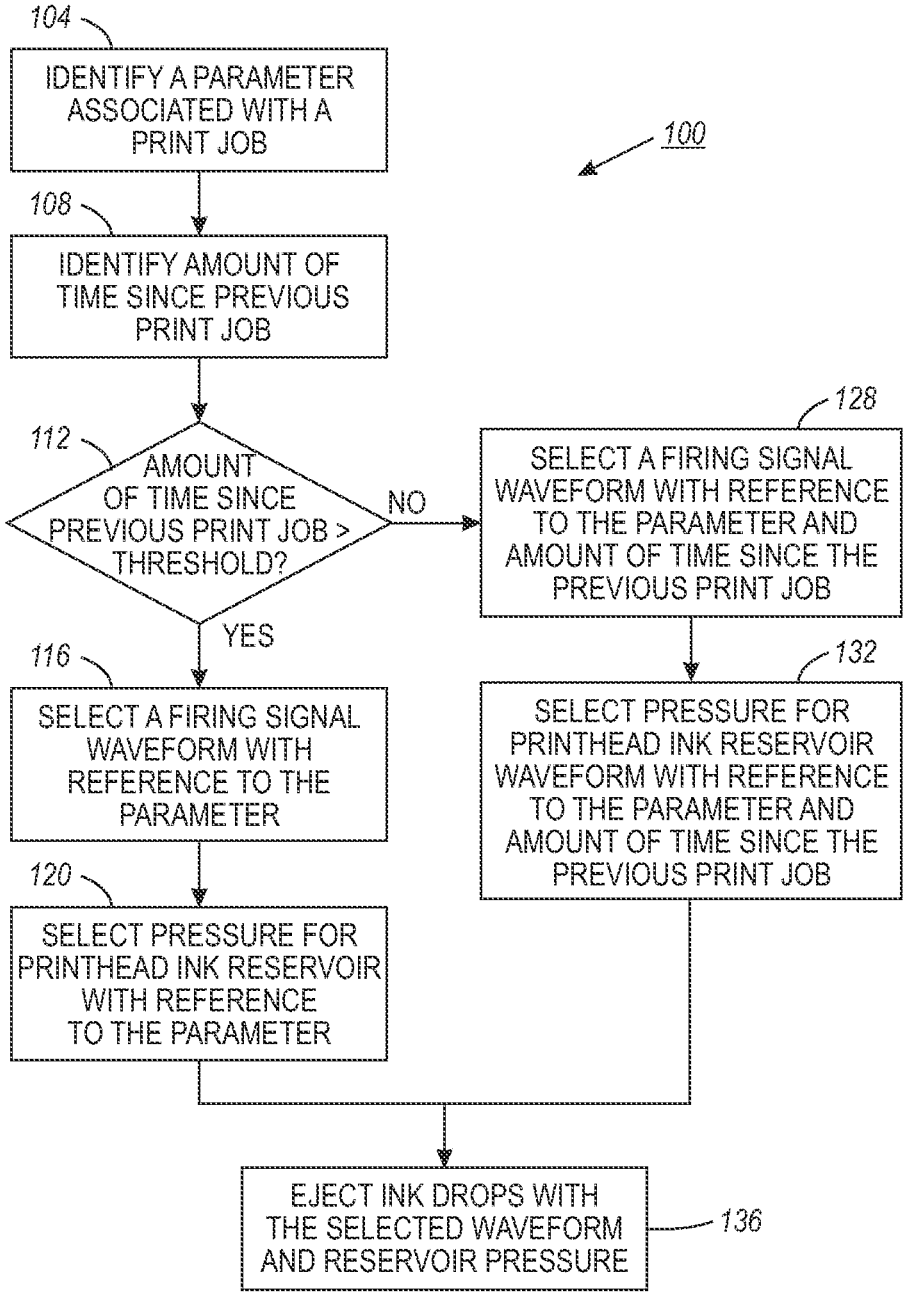
FIG. 1 is a block diagram of a process for controlling the drop mass and velocity of ink drops ejected from ink ejectors in a printhead.

For a general understanding of the environment for the system and method disclosed herein as well as the details for the system and method, reference is made to the drawings. In the drawings, like reference numerals have been used throughout to designate like elements. As used herein the term "printer" refers to any imaging device that is configured to eject a marking agent upon an image receiving surface and includes, for example, photocopiers, facsimile machines, multifunction devices, as well as direct and indirect inkjet printers that are configured to use phase-change, aqueous, solvent-based, or UV curable gel inks and the like. As used herein the term "print job" refers to a series of data sent to a printer that specify various job parameters, commands, and image data corresponding to one or more images for the printer to generate. The image data for each image specify various image elements, such as text, graphics, and overlays. Overlays include markings such as gloss coatings and watermarks. The printer executes a print job to print one or more pages or sheet on a sheet-fed printer or a unit segment of continuous web on a web-fed printer. The series of data in a print job may further include image data that specifies colors that correspond to one or more ink colors for use in generating the images. The printer forms images and performs various actions in accordance with data and parameters in the print job to execute the print job. As used herein the term "color separation" refers to image data that correspond to a single color of ink used in a multi-color image, where a multi-color image includes at least two color separations. As used herein, the term "firing signal" refers to an electrical signal generated in a printer that actuates an actuator in an inkjet ejector. The firing signal enables the inkjet ejector to eject an ink drop. A "firing signal waveform" may refer to one or more of the frequency, amplitude, phase, and wave shape of a firing signal, where various firing signal waveforms may alter the mass and ejection speed of ejected ink drops.

FIG. 1 depicts a process 100 for selecting a level of pressure and an electrical firing signal waveform for operating a printhead. The pressure level refers to a positive or negative pressure established in a reservoir coupled to ink ejectors in a printhead and the electrical firing signal waveform is the firing signal to be delivered to the printhead to operate the inkjet ejectors in the printhead that are also coupled to the reservoir. The pressure level and electrical firing signal are selected with reference to a parameter received in a print job. Process 100 begins by identifying at least one parameter associated with a print job received by a printer (block 104). The parameter may be included with a series of data transmitted as part of the print job, or the parameter may be a set point identified for multiple print jobs, such as a setting entered by an operator of the printer. Various parameters, including, but not limited to, color/monochrome settings, print speed, image quality, color density, and image coverage parameters may be associated with a print job." "Image coverage parameter" refers to a parameter that affects the amount of ink formed on an area of the image receiving surface. For example, if a print job indicates that an area of an image receiving surface should have black ink, the image coverage parameter may specify a percentage of the corresponding image receiving surface area that receives black ink drops. Ejecting ink drops with a mass and/or ink volume that are larger than a default or normalized size can increase the image coverage, while ink drops with a mass and/or ink volume that are larger than the default or normalized size can reduce the image coverage. In many printhead embodiments, a negative correlation exists between ink drop mass and ink drop velocity. Thus, as the mass of an ink drop decreases, the velocity at which the ink drop is ejected from the printhead increases. The accuracy of where the ink drop lands on the image receiving surface is related to the velocity, with higher velocity ink drops having shorter flight times that reduce inaccuracies in ink drop placement that occur as the ink drop travels toward the image receiving surface. Additionally, in multi-color print jobs each color separation present in the print job may have one or more parameters that are specific to only one color in the print job.

Process 100 identifies the length of time between the current print job and the print job preceding the current print job (block 108). The length of time between the previous and current print jobs may change the ink drop ejection behavior when the ink ejectors do not eject ink for various lengths of time. As the inkjet ejectors in each printhead eject ink drops, the mass and velocity of ejected ink drops may change over time, even if other operating settings in the printer remain substantially constant. Additionally, ink drops ejected in an intermittent manner may exhibit transient behavior where ejected ink drops have wider variations in drop mass and velocity than ink drops ejected from ink ejectors in a continuous manner. The transient behavior may result in ink drop placement errors on the image receiving surface if left uncorrected. The identification of the time period since the ink ejectors last ejected ink drops enables process 100 to compensate for transient behavior by selecting ink reservoir pressures and firing signals with respect to the current state of each printhead in the printer. Process 100 compares the amount of time since the previous print job completed to a predetermined threshold (block 112), which is typically measured in minutes, but only threshold limits may be shorter or longer.

If the length of the time period elapsed since the previous print job exceeds the predetermined threshold (block 112), process 100 selects a firing signal (block 116) and ink reservoir pressure (block 120) with reference to one or more of the identified parameters associated with the print job. In one embodiment, a controller, such as a microcontroller, application specific integrated circuit (ASIC), microprocessor, or other computing device accesses a memory that contains a plurality of data values corresponding to different firing signal waveforms and reservoir pressure combinations that have been empirically determined for various scenarios as explained in more detail below. The controller selects firing signal waveform data and pressure data with reference to the identified parameter. For example, the identified parameter may act as an index into a lookup table, database, or other data querying method appropriate for use with the stored data. An empirical process carried out using the printer or a device having a similar configuration to the printer may be used to generate the data stored in the memory for use in similarly configured printers. The printer may be repeatedly operated with particular types of print jobs or with the same type of print jobs being performed on a periodic basis. The pressure level in printhead reservoir and the firing signal waveform used to operate the inkjet ejectors are changed and the image quality measured to identify the pressure level/firing signal waveform combinations that provide an optimal image quality for a particular scenario. Additionally, various identified print job parameters may be selected and the degree of correlation for a parameter and a particular pressure/waveform combination identified. For example, if the image coverage parameter is included with a print job or can be identified from other data in a print job, the memory may hold various firing signal frequencies and reservoir pressure data for coverage parameters that exceed a given threshold, such as 50% coverage, while coverage parameters that are less than 50% correspond to a single waveform and pressure value. The selection process for the firing signal waveform and reservoir pressure may be carried out in any order, or may be carried out concurrently.

In an alternative embodiment, a printer may use sensors to generate data that identify the drop masses and velocities of ink drops ejected from each ink ejectors in each printhead. The printer may perform the processing of blocks 116 and 120 using the data generated by the sensors and an adjustment algorithm, instead of accessing a priori information held in the memory. In one example, a detected ink drop volume is measured as 23 picoliters, and a print job parameter corresponds to a print mode that uses 17 picoliter drops. Since the mass and volume of each drop correspond to one another, each 23 picoliter drop has a correspondingly higher mass than each 17 picoliter drop. The algorithm may select a negative pressure having a magnitude of 5 inches of water to apply to an ink reservoir that is coupled to the printhead to reduce the volume of the ink drops ejected by the ink ejectors in the printhead to 17 picoliter. Common examples of suitable sensors include optical sensors that detect light reflected from various locations on the image receiving surface after ink drops are ejected onto the image receiving surface.

In cases where the length of time between the previous print job and the current print job is less than the predetermined threshold (block 112), process 100 selects a firing signal waveform and pressure to apply to the printhead ink reservoir with reference to both the identified parameter and the length of time between print jobs (block 128 and 132). The selection of firing signal waveform and pressure may occur in a similar manner as described above, with the selection being made with further reference to length of time between the current print job and the previous print job. In one embodiment, a memory may store various predetermined data corresponding to waveforms and pressure levels for the identified parameter and one or more lengths of time between print jobs. In another embodiment, the memory may store data corresponding to the waveform and pressure levels, and the selected firing signal waveform and reservoir pressure may be adjusted with reference to the amount of time between the previous print job and the current print job. In still another embodiment, the firing signal and ink reservoir pressure may be selected with reference to the identified parameter, length of time between the previous and current print jobs, and the input of one or more sensors in the printer.

Process 100 ejects ink drops in accordance with the print job using the selected firing signal waveforms and ink reservoir pressure levels (block 136). In each printhead, the level of pressure applied to the ink reservoir in fluid communication with the ink ejectors may be a positive pressure or a negative pressure of different magnitudes. In one embodiment, the pressure is generated using a Venturi pump that applies the selected pressure to an air space over the ink in the ink reservoir. Under positive pressure, the air space has a pressure level that is higher than the ambient pressure surrounding the ink ejectors, and the positive pressure urges ink in the reservoir to flow to ink ejectors in each printhead. Under negative pressure, the air space has a pressure level that is lower than the ambient pressure surrounding the ink ejectors, and the negative pressure slows a flow of ink from the ink reservoir to the ink ejectors in each printhead. The selected electrical firing signals may include waveforms having various wave shapes, firing frequencies, and signal amplitudes. In multi-color printers, process 100 may be carried out for each ink color to select different waveforms and reservoir pressures selected for one or more printheads of each ink color in response to parameters that are specific to individual color separations in the print job. Additionally, the measurement of time between print jobs may be specific to individual ink colors since the printer may have only used one or some of the available printheads to execute the previous print job, such as using only black ink in a previous monochrome print job.

Figure 2:
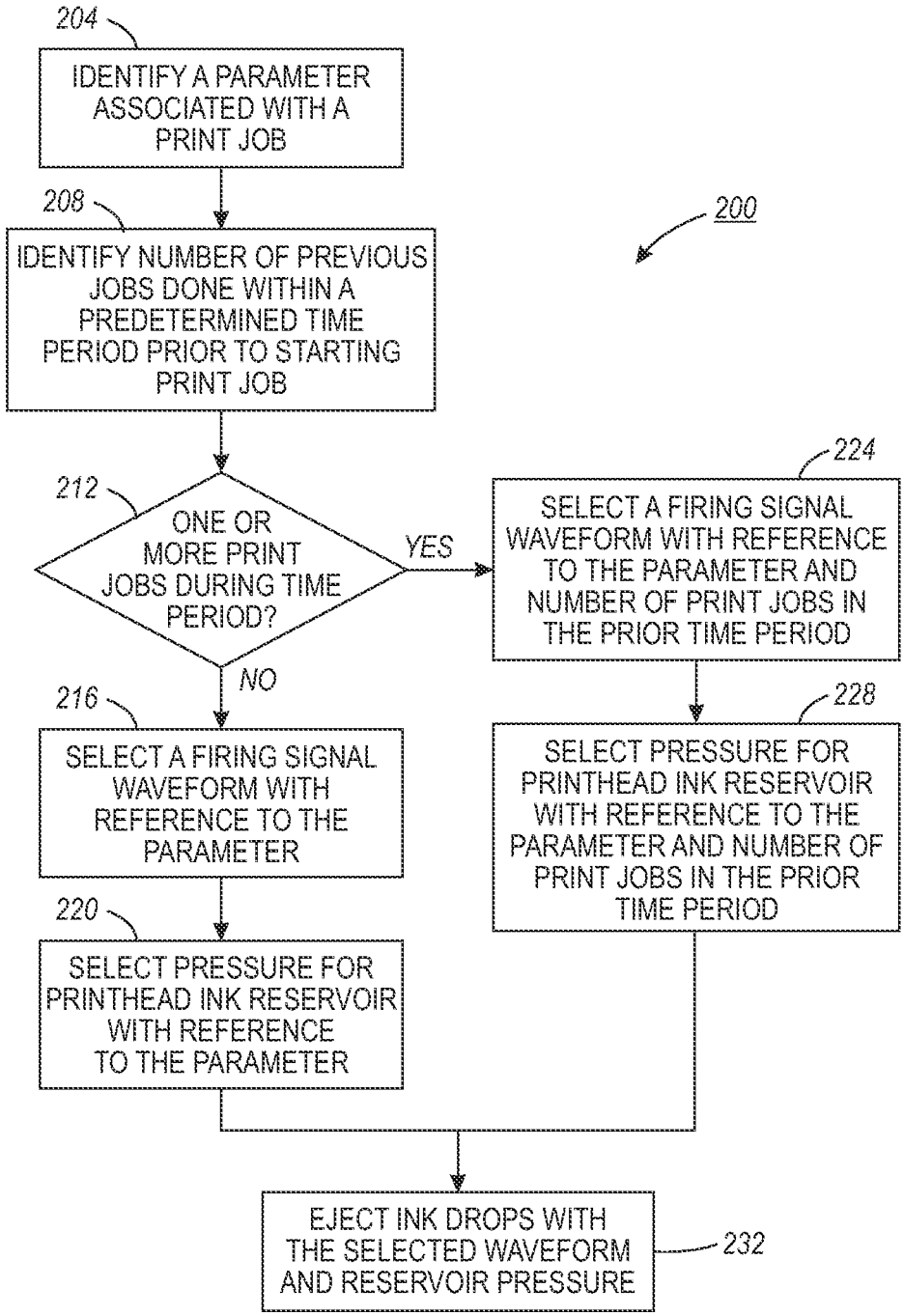
FIG. 2 is a block diagram of an alternative process for controlling the drop mass and velocity of ink drops ejected from ink ejectors in a printhead.

FIG. 2 depicts an alternative process 200 for selecting a level of pressure to apply to ink in a reservoir coupled to ink ejectors and electrical firing signal waveforms during a print job with reference to at least one parameter associated with the print job. Process 200 identifies at least one parameter associated with a print job (block 204) in a similar many described above with reference to process 100. Process 200 identifies the number of print jobs that have preceded the current print job within a predetermined time period (block 208). As described above, inkjet ejectors may have transient behavior when ejecting ink drops in an intermittent manner. Identifying the number of print jobs that have occurred in a predetermined time period prior to beginning the current print job enables process 200 to compensate for transient behavior by selecting ink reservoir pressure and firing signals with respect to the current state of each printhead in the printer. Process 200 identifies the number of print jobs completed in a predetermined time period prior to receiving the current print job (block 212), which is typically measured in minutes, but only threshold limits may be shorter or longer.

If no print jobs occurred during the predetermined time period preceding the current print job (block 212), process 200 selects a firing signal waveform (block 216) and reservoir pressure (block 220) with reference to one or more of the identified parameters associated with the print job. The firing signal and reservoir pressure may be selected from predetermined data held in a memory or generated by the printer in a manner similar to that of process 100 described above.

If at least one print job occurred during the predetermined time period preceding the current print job (block 212), process 200 selects a firing signal waveform to apply the inkjet ejectors in a printhead and a pressure to apply to the printhead ink reservoir with reference to both the identified parameter and the number of print jobs that preceded the current print job during the predetermined time period (block 224 and 228). Various embodiments of process 200 may select the firing signal waveform and ink reservoir pressure from predetermined values stored in a memory based on both the identified parameter associated with the print job and the number of print jobs that occurred during the previous time period. Alternatively, the process 200 may select the firing signal waveform and ink reservoir pressure from the memory, and then adjust at least one of the selected firing signal waveform values and ink reservoir pressure values with respect to the identified number of previous print jobs. In still another embodiment, the firing signal and ink reservoir pressure may be selected with reference to the identified parameter, identified number of print jobs in the previous time period, and the input of one or more sensors in the printer. The selection process for the firing signal waveform and reservoir pressure may be carried out in any order, or may be carried out concurrently.

Process 200 ejects ink drops in accordance with the print job using the selected firing signal waveforms and ink reservoir pressure levels in a manner similar to process 100 (block 232). As with process 100, process 200 may be carried out for each ink color in a multi-color printer to select different waveforms and reservoir pressures selected for one or more printheads of each ink color in response to parameters that are specific to individual color separations in the print job. Additionally, the measurement of time between print jobs may be specific to individual ink colors since the printer may have only used one or some of the available printheads to execute the previous print job, such as a black and white print job.

Both of the processes 100 and 200 described above may be carried out for each print job executed by the printer. Changes to identified print job parameters may result in different reservoir pressure and firing signal waveforms being chosen for a first print job and a second print job. Due to compensation for transient behavior, a second print job occurring within the predetermined time periods of at least one earlier print job may have different pressure levels and firing signal waveforms than the earlier print job even if the identified parameters remain the same for both the first and second print jobs.

In some embodiments of multi-color printers, processes 100 and 200 may select different pressure levels and waveforms that eject ink drops having substantially equal drop masses and velocities between inks having different colors and correspondingly different chemistries. In other embodiments, color separation parameters may indicate that ink drops of different colors should have different drops masses and velocities. For example, a high coverage parameter for black ink may indicate a larger drop mass and lower drop velocity than a drop mass and drop velocity used for yellow ink having a low coverage parameter. In still other embodiments, the printheads for each ink color may instead use a common pressure and firing signal waveform.

Figure 3:
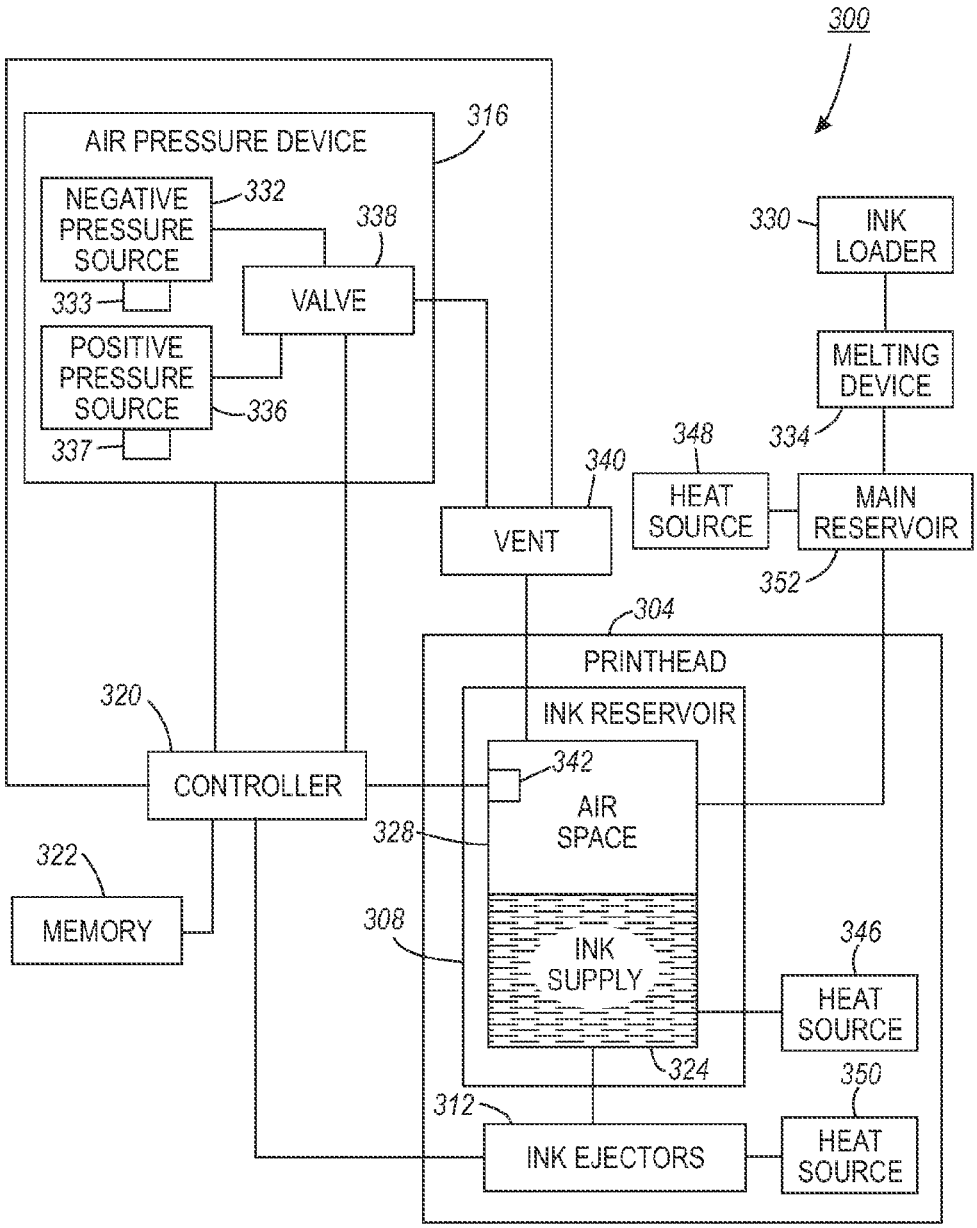
FIG. 3 is a schematic of a inkjet printer configured to control the drop mass and velocity of ink drops ejected from at least one printhead in the printer.

FIG. 3 shows a diagram of a printer 300. The printer 300 ejects drops of liquid ink onto an image receiving surface (not illustrated) to form at least a portion of a printed image. The term "liquid ink" as used herein, includes, but is not limited to, aqueous inks, liquid ink emulsions, pigmented inks, phase change inks in a liquid phase, and gel inks that are heated or otherwise treated to alter the viscosity of the ink for improved jetting. The printer 300 includes, among other components, a printhead 304 having at least one ink reservoir 308 and at least one corresponding group of ink ejectors 312, an air pressure device 316, and a controller 320. The reservoir 308 contains a supply of liquid ink 324 and defines an air space 328 above the ink 324. The ink ejectors 312 are fluidly coupled to the reservoir 308 for ejecting ink drops of the supply of ink 324 onto the image receiving surface. The air pressure device 316 is fluidly coupled to the air space 328 for controlling an air pressure of the air space 328. The controller 320, among other functions, controls the mass and velocity of the ink drops ejected by the ink ejectors 312 by selectively activating the air pressure device 316 to regulate an air pressure of the air space 328 and by providing a selected firing signal waveform to the ink ejectors 312 when ejecting ink drops.

The ink reservoir 308 defines a volume for containing the ink 324 and the air space 328. The reservoir 308 may have a cross section of any shape, including, but not limited to, rectangular, circular, and elliptical. The supply of ink 324 may be any ink suitable for ejection by the ink ejectors 312, including, but not limited to, phase change ink, gel ink, and aqueous ink, as described below. The air space 328 is a volume of the reservoir 308 that is unoccupied by the ink 324. The reservoir 308 may define a closed space that is isolated from the atmosphere, to permit the air pressure device 316 to maintain a particular gauge pressure in the air space 328. As used herein, gauge pressure refers to a pressure level relative an ambient air pressure surrounding the printer 300. The ambient air pressure is often the atmospheric pressure. Therefore, gauge pressure may be a difference between the absolute pressure and the atmospheric pressure. A manifold (not illustrated) fluidly couples the reservoir 308 to the ink ejectors 312.

The printer 300 may be configured to form printed images with phase change ink and/or gel ink. The term "phase change ink" encompasses inks that remain in a solid phase at an ambient temperature and that melt into a liquid phase when heated above a threshold temperature, referred to as a melt temperature. The ambient temperature is the temperature of the air surrounding the printer 300. The ambient temperature may be a room temperature when the printer 300 is positioned in a defined space. The ambient temperature may be above a room temperature when portions of the printer 300, such as the printhead 304, are enclosed by, for example, a cover. An exemplary range of melt temperatures is approximately seventy to one hundred forty degrees Celsius; however, the melt temperature of some types of phase change ink may be above or below the exemplary temperature range. Phase change ink is ejected onto a substrate in the liquid phase. The terms "gel ink" or "gel-based ink" encompass inks that remain in a gelatinous state at the ambient temperature and that may be altered to have a different viscosity suitable for ejection by the printhead 304. In particular, gel ink in the gelatinous state may have a viscosity above $10^4$ centipoises (cPs); however, the viscosity of gel ink can be reduced, to a low viscosity (1-20 cPs) suitable for ejection, by heating the ink above a threshold temperature, referred to as a jetting temperature. An exemplary range of jetting temperatures is approximately seventy five to eighty five degrees Celsius; however, the jetting temperature of some types of gel ink may be above or below the exemplary temperature range.

Some inks, including gel inks, may be cured during the printing process. Radiation curable ink becomes cured after being exposed to a source of radiation. Suitable radiation may encompass the full frequency (or wavelength) spectrum, including but not limited to, microwaves, infrared, visible, ultraviolet, and x-rays. In particular, ultraviolet-curable gel ink, referred to herein as UV gel ink, becomes cured after being exposed to ultraviolet radiation. As used herein ultraviolet radiation includes radiation having a wavelength between ten nanometers to four hundred nanometers.

As shown in FIG. 3, a printer 300 configured to form images with phase change ink and/or gel ink may include an ink loader 330, a melting device 334, and a main reservoir 352. The ink loader 330 contains a quantity of phase change ink in the solid phase or a quantity of gel ink in the gelatinous phase. Phase change ink is supplied to the ink loader 330 as solid ink pellets or solid ink sticks, among other forms. Gel ink is supplied to the ink loader 330 in a gelatinous form. The ink loader 330 moves the phase change ink or the gel ink toward the melting device 334, which heats at least a portion of the ink to form liquid ink. The melter 334 generates heat to form the liquid ink when a detected level of ink in the main reservoir 352 drops below a predetermined threshold. The melter 334 may be deactivated when the level of ink in the main reservoir 352 is above the predetermined threshold. The liquid ink is delivered to the main reservoir 352, which is thermally coupled to a heater 348. The heater 348 is configured to maintain the main reservoir 352 at a temperature that maintains the ink in the liquid phase. Liquid ink from the main reservoir 352 is delivered to the ink reservoir 308 for ejection by the ink ejectors 312. The printhead 304 includes a heater 346 for maintaining the ink contained by the ink reservoir 308 in the liquid phase and a heater 350 for maintaining the ink contained by ink ejectors 312 in the liquid phase.

The main reservoir 352 and the ink reservoir 308 remain connected to the printer 300 during normal usage and servicing of the printer 300. Specifically, in response to the ink level in the ink reservoir 308 falling below a predetermined minimum level, the printer 300 refills the ink reservoir 308 until the ink level reaches a predetermined maximum level with liquid ink from the main reservoir 352. Similarly, in response to the ink level in the main reservoir 352 falling below a predetermined minimum level, the melting device 334 heats a portion of the ink in the ink loader 330 and fills the main reservoir 352 with additional liquid ink until the ink level reaches a predetermined maximum level. Accordingly, in one embodiment, neither the main reservoir 352 nor the ink reservoir 308 are disposable units configured to be replaced in response to the printer 300 exhausting an ink supply.

The ink ejectors 312 eject drops of liquid ink onto an image receiving surface in response to receiving a firing signal from the controller 320. As used herein, ejecting ink onto a substrate includes, but is not limited to, ejecting ink with thermal ink ejectors and ejecting ink with piezoelectric ink ejectors. The firing signal is an electrical signal having a selected waveform to enable each of the ink ejectors 312 to eject ink drops having the selected mass and velocity as described above. Controller 320 may generate firing signal waveforms having various frequencies, amplitudes, phases, and wave shapes that are appropriate for operating the type of inkjet ejectors, thermal or piezoelectric, in a printhead. The ink ejectors 312 may be positioned to eject ink drops in a downward direction. For instance, the ink ejectors 312 may be positioned to eject ink drops in a downward direction no more than fifteen degrees from vertical. Alternatively, the ink ejectors 312 may be positioned to eject ink drops in a lateral direction no more than thirty degrees from horizontal.

The mass of the ink drops ejected by the ink ejectors 312 is at least partially determined by the air pressure of the air space 328 and by the firing signals that controller 320 generates to eject ink drops. In particular, in response to the air pressure in the air space 328 being approximately equal to the atmospheric pressure, the ink ejectors 312 eject liquid ink drops having a default mass. In response, however, to the air pressure within the air space 328 being other than the atmospheric pressure, the ink ejectors 312 eject liquid ink drops having a mass other than the default mass, as described below.

The air pressure device 316 is fluidly coupled to the air space 328 and is electrically coupled to the controller 320. The air pressure device 316 is configured to control an air pressure of the air space 328 in response to being selectively activated by the controller 320. As shown in FIG. 3, the air pressure device 316 includes a negative air pressure source 332, a positive air pressure source 336, and a valve 338. The negative air pressure source 332 maintains a negative gauge pressure in the air space 328 during the printing process. The negative pressure maintains, at least in part, the ink menisci inside a plurality of ejector nozzles (not illustrated) of the printhead 304 to prevent liquid ink from seeping from the printhead 304. Anti-wetting coatings formed around the openings of the ejector nozzles also prevent seepage of liquid ink from the printhead 304. The positive air pressure source 336 maintains a positive gauge pressure in the air space 328. The positive pressure may be used when ejecting ink drops onto an image receiving surface, for purging ink from the ink ejectors 312, and to clean or otherwise maintain the printhead 304. The negative air pressure source 332 and the positive air pressure source 336 may be any type of pressure source including, but not limited to, Venturi pumps. Depending on the embodiment, the air pressure device 316 may be coupled to a source of electrical power (not illustrated).

The valve 338 is fluidly coupled to the reservoir 308, the negative air pressure source 332, and the positive air pressure source 336. As shown in the embodiment of FIG. 3, the valve 338 is also electrically coupled to the controller 320. In a first position, the valve 338 couples the negative pressure source 332 to the reservoir 308 and decouples the positive pressure source 336 from the reservoir 308. In a second position, the valve 338 couples the positive pressure source 336 to the reservoir 308 and decouples the negative pressure source 332 from the reservoir 308. The valve 338 is moved between the first and second positions in response to electronic signals generated by the controller 320.

As illustrated in the embodiment of FIG. 3, air pressure sensors 333 and 337 generate control signals indicative of the magnitudes of air pressure applied by the negative pressure source 332 and positive pressure source 336, respectively. The controller 320 may be electrically coupled to the sensors 333 and 337. The controller 320 compares the air pressure generated by the negative pressure source 332 and positive pressure source 336 and compares the magnitudes to an air pressure set point. The controller 320 selectively activates the air pressure device 316 to maintain the air pressure at the set point. In another configuration, a sensor 342 is positioned in the air space 328. The sensor 342 generates a control signal indicative of the air pressure in the air space 328. The sensors 333, 337, and 342 are any type of sensor capable of generating a signal indicative of a gauge air pressure within a range of approximately −10.0 to 10.0 inches of water. Different configurations of printer 300 may include sensors 333 and 337, sensor 342, or a combination of all three sensors. Still another configuration of the printer 300 uses a calibrated negative pressure source 332 and calibrated positive pressure source 336, and omits the sensors 333, 337, and 342. In this configuration, controller 320 generates a control signal corresponding to the air pressure set point, and the air pressure device 316 generates the selected air pressure.

The printer 300 includes a vent 340 configured to couple fluidly the air space 328 to the air pressure device 316. In the embodiment illustrated in FIG. 3, a first end of the vent 340 is connected to an opening in the reservoir 308, and a second end of the vent 340 is connected to the valve 338 of the air pressure device 316. The vent 340 forms an air and liquid impervious seal with both the air pressure device 316 and the reservoir 308 to enable the air pressure device 316 to maintain a positive or negative gauge pressure within the air space 328. The vent 340 may exhibit a degree of rigidity to permit the vent 340 to maintain an approximately fixed inner dimension when subjected to an increased or decreased air pressure level. In one embodiment, the vent 340 is a hollow tube exhibiting a degree of flexibility to permit the vent 340 to couple easily the air pressure device 316 to the reservoir 308 via a curved or irregular path.

The embodiment of the air pressure device 316 illustrated in FIG. 3 is operable to apply different levels of negative and positive pressure to the ink reservoir for all types of ink configured to be ejected as liquid ink from an ink ejector 312. The air pressure imparted on the air space 328 depends, at least in part, on the surface tension, density, and viscosity of the liquid ink in the reservoir 308. Liquid ink formed from phase change ink and gel ink may have a surface tension that is lower than that of aqueous ink. Therefore, compared to the magnitude of negative pressure required to reduce the mass of an aqueous ink drop by a certain percentage, a smaller magnitude of negative pressure may be required to reduce the mass of a solid-ink or gel-ink ink drop by the same percentage. The variation in pressure that forms a meniscus arises because liquid ink having a comparatively high surface tension needs a larger magnitude of negative pressure to form a desired meniscus inside nozzles of the ink ejectors 312 than liquid ink having a comparatively low surface tension. Accordingly, the air pressure device 316 may be configured to impart an air pressure level or a range of air pressure levels upon the air space 328 based on the surface tension of the liquid ink contained by the reservoir 308.

The controller 320 controls the mass of the ink drops ejected by the ink ejectors 312 by selectively activating the air pressure device 316 to increase or to decrease the air pressure in the air space 328 and by selectively applying electrical firing signals having various signal waveforms to the ink ejectors 312. For instance, the controller 320 may activate the air pressure device 316 to maintain a negative gauge pressure in the air space 328. In particular, the controller 320 sends an electronic signal to the air pressure device 316 that causes the air pressure device 316 to move the valve 338 to a position, which couples the air space 328 to the negative pressure source 332. Consequently, in response to receiving a firing signal from the controller 320, the ink ejectors 312 eject ink drops having a mass less than the default ink drop mass. An exemplary negative gauge pressure is 0.5 to 6.0 inches of water. In general, increasing the magnitude of the negative gauge pressure reduces the mass of the ink drops ejected by the ink ejectors 312. Controller 320 may also send a signal to air pressure device 316 to move valve 338 to a position that couples positive pressure source 336 to the air space 328. In general, increasing the magnitude of positive pressure increases the mass of the ink drops ejected by the ink ejectors 312. Firing signals having various selected waveforms may also affect the mass of liquid ink drops ejected through ink ejectors 312.

Memory 322 is operatively connected to controller 320 and stores data that correspond to predetermined settings for firing signal waveforms and air pressure levels that enable ink ejectors 312 to eject ink drops having known masses and ejection velocities. The memory 322 may be any data storage device that is suitable for storing the wave form and pressure data for use by controller 320. Memory 322 may further hold the firing signal waveform and pressure data in a lookup table, database, or any other data structure that enables controller 320 to identify firing signal and pressure data that correspond to at least one parameter associated with a print job. For example, a coverage parameter associated with a print job identifies a fraction of the image receiving surface to cover in ink in locations corresponding to image data in the print job. Ejecting ink drops having a higher mass may increase the image coverage, and ejecting ink drops with a lower mass may decrease the image coverage. Controller 320 may retrieve firing signal waveforms and air pressure levels from memory 322 that correspond to the coverage area parameter for the print job.

In operation, controller 320 operates printhead 304 to generate one or more ink images corresponding to image data received in a print job. Controller 320 identifies at least one parameter associated with each print job to select an air pressure level to apply to air space 328 through air pressure device 316, and a firing signal waveform to use when firing ink ejectors 312. In printers configured to generate ink drops with multiple colors, controller 320 may select air pressure levels and firing signal wave forms for separate parameters for each color separation in a multi-color print job. Controller 320 may retrieve the pressure and firing signal parameters from memory 322, and in a multi-color printer, memory 322 may hold separate pressure and firing signal data corresponding to parameters for each ink color.

During operation, controller 320 may optionally retain records of previous print jobs, including the amount of time since the previous print job was executed, and the number of print jobs that have occurred during a predetermined time period prior to the current print job. Controller 320 may adjust the amount of pressure applied to the ink reservoir air space 328 and the firing signal waveforms generated for ink ejectors 312 to compensate for the effects of the prior print jobs on the mass and velocity of ink drops ejected from ink ejectors 312. In a multi-color printer, controller 320 may retain records for print jobs that indicate when each ink color was used in prior print jobs.

The embodiment depicted in FIG. 3 shows a single printhead 304 and ink reservoir 308. An alternative embodiment may include a multi-color printhead that includes a plurality of separate ink reservoirs such as ink reservoir 308. Each reservoir includes a separate vent similar to vent 340 that places the ink reservoir in communication with the air pressure device 316 through a valve such as valve 316. Thus, the ink reservoir for each color of ink may have a level of positive or negative pressure applied that is different from the pressure levels in reservoirs holding inks of different colors. Similarly, controller 320 is electrically coupled to ink ejectors for each of the different ink colors, and may generate different firing signal waveforms for the ink ejectors coupled to each of the different ink colors. In another alternative embodiment, two or more printheads each holding ink having a different color may similarly be individually coupled to the air pressure device and controller. In either alternative embodiment, the controller 320 is configured to adjust both the air pressure in an air space above ink in each ink reservoir and to control the firing signal waveform to adjust the mass and velocity of ink drops ejected from the ink ejectors with reference to at least one parameter associated with the print job.

It will be appreciated that variants of the above-disclosed and other features and functions, or alternatives thereof, may be desirably combined into many other different systems, applications or methods. For example, while the inkjet assemblies depicted herein have four arrays for four ink colors, alternative embodiments may include ejector arrays configured to use ink of various colors. Various presently unforeseen or unanticipated alternatives, modifications, variations or improvements therein may be subsequently made by those skilled in the art which are also intended to be encompassed by the following claims.

What is claimed:

1. A method for operating a printer comprising:

identifying a parameter associated with a first color separation for the print job;

identifying a parameter associated with a second color separation for the print job;

selecting a firing signal waveform for the first color separation of the print job that corresponds to the parameter identified for the first color separation;

selecting a firing signal waveform for the second color separation of the print job that corresponds to the parameter identified for the second color separation;

selecting a pressure for the first color separation of the print job that corresponds to the parameter identified for the first color separation;

selecting a pressure for the second color separation of the print job that corresponds to the parameter identified for the second color separation;

operating at least one ink ejection device in a first assembly of ink ejection devices that ejects ink having a color corresponding to the first color separation with reference to the firing signal waveform and the pressure selected for the first color separation; and operating at least one ink ejection device in a second assembly of ink ejection devices that ejects ink having a color corresponding to the second color separation with reference to the firing signal waveform and the pressure selected for the second color separation.

2. The method of claim 1, the parameter identification for at least one of the first and the second color separations further comprising:

identifying at least a firing signal frequency for the at least one ink ejection device.

3. The method of claim 1, the parameter identification for at least one of the first and the second color separations further comprising:

identifying a coverage parameter for at least one of the first and second color separations of the print job; and selecting the firing signal waveform and the pressure for the at least one of the first and second color separations with reference to a comparison of the coverage parameter for the at least one color separation and a predetermined threshold.

4. The method of claim 1, the parameter identification for at least one of the first and the second color separations further comprising:

identifying at least a time since a previous print job; and selecting the firing signal waveform and the pressure for the at least one of the first and second color separations with reference to a comparison of a length of time since the previous print job and a predetermined threshold.

5. The method of claim 1, the parameter identification for at least one of the first and the second color separations further comprising:

identifying at least a number of print jobs performed during a time period preceding the print job; and selecting the firing signal waveform and the pressure for at least one of the first separation and the second color separations with reference to a comparison of an identified number of print jobs and a predetermined threshold.

6. The method of claim 1 further comprising:

storing the firing signal waveform and the pressure selected for the first color separation in a memory in association with parameter identified for the first color separation; and storing the firing signal waveform and the pressure selected for the second color separation in the memory in association with the parameter identified for the second color separation.

7. A method of operating a printer comprising:

identifying at least one parameter associated with a first print job;

selecting a firing signal waveform corresponding to the identified parameter;

selecting a pressure corresponding to the identified parameter;

operating at least one ink ejection device with reference to the selected firing signal waveform and the selected pressure;

receiving another print job;

identifying a parameter associated with the other print job;

selecting a firing signal waveform corresponding to the parameter identified for the other print job;

selecting a pressure corresponding to the parameter identified for the other print job, at least one of the firing signal waveform and the pressure selected for the other print job being different than one of the firing signal waveform and pressure selected for the first print job; and operating the at least one ink ejection device with reference to the different firing signal waveform or pressure selected for the other print job.

8. A printer comprising:

a first ink reservoir configured to contain a supply of ink and an air space above the supply of ink;

a second ink reservoir configured to contain a supply of ink and an air space above the supply of ink;

a first air pressure device fluidly coupled to the air space above the supply of ink in the first reservoir;

a second air pressure device fluidly coupled to the air space above the supply of ink in the second ink reservoir;

a first ink ejection device fluidly coupled to the first ink reservoir, the first ink ejection device configured to receive ink from the supply of ink in the first reservoir and to eject ink onto an image receiving surface;

a second ink ejection device fluidly coupled to the second ink reservoir, the second ink ejection device configured to receive ink from the supply of ink in the second ink reservoir and to eject ink drops onto the image receiving surface; and a controller coupled to the first and second ink ejection devices and the first and second air pressure devices, the controller being configured to identify a parameter associated with a first color separation and to identify a parameter associated with a second color separation associated with a print job, select a firing signal waveform for the first color separation of the print job corresponding to the identified parameter for the first color separation and select a firing signal waveform for the second color separation of the print job corresponding to the identified parameter for the second color separation, select a pressure corresponding to the identified parameter for the first color separation of the print job and a pressure corresponding to the identified parameter for the second color separation of the print job, provide the selected firing signal waveform for the first color separation to the first ink ejection device fluidly connected to the ink reservoir that supplies ink having a color corresponding to the first color separation and provide the firing signal waveform selected for the second color separation to the second ink ejection device fluidly connected to the second ink reservoir that supplies ink having a color corresponding to the second color separation, activate the first air pressure device to establish the selected pressure for the first color separation in the air space above the supply of ink in the first ink reservoir that supplies ink having a color corresponding to the first color separation, and activate the second air pressure device to establish pressure for the second color separation in the air space above the supply of ink in the second ink reservoir that supplies ink having a color corresponding to the second color separation.

9. The printer of claim 8, the controller being further configured to identify the parameter for the first color separation and the parameter for the second color separation for the print job by identifying a firing signal frequency for the at least one printhead.

10. The printer of claim 8, the controller being further configured to identify the parameter for the first color separation and the parameter for the second color separation for the print job by identifying a coverage parameter for at least one color separation of the print job and selecting the firing signal waveforms and the pressures for the first and second color separations with reference to a comparison of the coverage parameter for the identified at least one color separation and a predetermined threshold.

11. The printer of claim 8, the controller being further configured to identify the parameter for the first color separation and the parameter for the second color separation for the print job by identifying a time since a previous print job, and selecting the firing signal waveform and the pressure for the first color separation and the firing signal waveform and the pressure for the second color separation with reference to a comparison of a length of time since the previous print job and a predetermined threshold.

12. The printer of claim 8, the controller being further configured to identify the parameter for the first color separation and the parameter for the second color separation for the print job by identifying a number of print jobs performed during a time period preceding the print job and selecting the firing signal waveform and the pressure for the first color separation and the firing signal waveform and the pressure for the second color separation with reference to a comparison of the identified number of print jobs and a predetermined threshold.

13. The printer of claim 8, the controller being further configured to store the selected firing signal waveform and pressure for the first color separation in a memory operatively connected to the controller in association with the parameter identified for the first color separation and the selected firing signal waveform and pressure for the second color separation in the memory in association with the parameter identified for the second color separation.

14. A printer comprising:

an ink reservoir configured to contain a supply of ink and an air space above the supply of ink;

an air pressure device fluidly coupled to the air space above the supply of ink;

at least one ink ejection device fluidly coupled to the ink reservoir, the at least one ink ejection device configured to receive ink from the supply of ink and to eject ink onto an image receiving surface; and a controller coupled to the at least one ink ejection device and the air pressure device, the controller being configured to identify a parameter associated with a print job received subsequent to a previous print job, select a firing signal waveform corresponding to the parameter identified for the subsequent print job, select a pressure corresponding to the parameter identified for the subsequent print job, select a firing signal waveform and a pressure that are different than a firing signal waveform and pressure selected for the previous print job, provide the firing signal waveform selected for the subsequent print job to the at least one ink ejection device fluidly connected to the ink reservoir, and activate the air pressure device to establish pressure in the air space above the supply of ink in the ink reservoir, the established pressure corresponding to the pressure selected for the subsequent print job.

15. An inkjet printer comprising:

a first ink reservoir configured to contain a supply of a gel ink and an air space above the supply of gel ink;

a first air pressure device fluidly coupled to the air space above the supply of gel ink in the first reservoir;

a first ink ejection device fluidly coupled to the first ink reservoir, the first ink ejection device configured to receive liquefied gel ink from the supply of gel ink in the first reservoir and to eject the liquefied gel ink onto an image receiving surface;

a second ink reservoir configured to contain a supply of a gel ink and an air space above the supply of gel ink;

a second air pressure device fluidly coupled to the air space above the supply of gel ink in the second reservoir;

a second ink ejection device fluidly coupled to the second ink reservoir, the second ink ejection device configured to receive liquefied gel ink from the supply of gel ink in the second reservoir and to eject the liquefied gel ink onto the image receiving surface; and a controller coupled to the first and second ink ejection devices and the first and second air pressure devices, the controller being configured to identify a parameter for a first color separation for a print job and a parameter for a second color separation for a print job, select a firing signal waveform corresponding to the identified parameter for the first color separation and a firing signal waveform corresponding to the identified parameter for the second color separation, select a pressure corresponding to the identified parameter for the first color separation and a pressure corresponding to the identified parameter for the second color separation, provide the selected firing signal waveform for the first color separation to the first ink ejection device, provide the selecting firing signal waveform for the second color separation to the second ink ejection device, activate the first air pressure device to establish the selected pressure for the first color separation in the air space above the supply of gel ink in the first reservoir, and activate the second air pressure device to establish the selection pressure for the second color separation in the air space above the supply of gel ink in the second reservoir.

16. The printer of claim 15, the controller being further configured to identify the parameter for at least one of the color separations for the print job by identifying a coverage parameter for the at least one color separation of the print job and selecting the firing signal waveform and the pressure for the at least one color separation with reference to a comparison of the coverage parameter for the at least one color separation and a predetermined threshold.

17. The printer of claim 15, the controller being further configured to identify the parameter for at least one of the color separations for the print job by identifying a time since a previous print job, and selecting the firing signal waveform and the pressure for the at least one color separation with reference to a comparison of a length of time since the previous print job and a predetermined threshold.

18. The printer of claim 15, the controller being further configured to identify the parameter for at least one color separation of the print job by identifying a number of print jobs performed during a time period preceding the print job and selecting the firing signal waveform and the pressure for the at least one color separation with reference to a comparison of the identified number of print jobs and a predetermined threshold.

19. The printer of claim 15, the controller being further configured to store the firing signal waveform and pressure selected for the first and second color separations in a memory operatively connected to the controller in association with the parameters identified for the first and second color separations, respectively.

20. A printer comprising:

an ink reservoir configured to contain a supply of a gel ink and an air space above the supply of gel ink;

an air pressure device fluidly coupled to the air space above the supply of gel ink;

at least one ink ejection device fluidly coupled to the ink reservoir, the at least one ink ejection device configured to receive liquefied gel ink from the supply of gel ink and to eject the liquefied gel ink onto an image receiving surface;

a controller coupled to the at least one ink ejection device and the air pressure device, the controller being configured to identify a parameter associated with a print job received subsequent to a previous print job, select a firing signal waveform corresponding to the parameter identified for the subsequent print job, select a pressure corresponding to the parameter identified for the subsequent print job, at least one of the selected firing signal waveform and the selected pressure being different than one of the firing signal waveform and pressure selected for the previous print job, provide the firing signal waveform selected for the subsequent print job to the at least one ink ejection device fluidly connected to the ink reservoir, and activate the air pressure device to establish pressure in the air space above the supply of gel ink in the ink reservoir, the established pressure corresponding to the pressure selected for the subsequent print job.

* * * * *